US008942394B2

(12) United States Patent
Conti et al.

(10) Patent No.: US 8,942,394 B2
(45) Date of Patent: Jan. 27, 2015

(54) INTEGRATED ACOUSTIC TRANSDUCER OBTAINED USING MEMS TECHNOLOGY, AND CORRESPONDING MANUFACTURING PROCESS

(75) Inventors: Sebastiano Conti, Mistretta (IT); Matteo Perletti, Boltiere (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 1067 days.

(21) Appl. No.: 12/644,602

(22) Filed: Dec. 22, 2009

(65) Prior Publication Data

US 2010/0158279 A1 Jun. 24, 2010

(30) Foreign Application Priority Data

Dec. 23, 2008 (IT) ..... TO2008A0983

(51) Int. Cl.

| | |
|---|---|
| ***H04R 25/00*** | (2006.01) |
| ***H04R 19/00*** | (2006.01) |
| ***H04R 7/24*** | (2006.01) |
| ***H04R 31/00*** | (2006.01) |
| *H04R 19/04* | (2006.01) |

(52) U.S. Cl.

CPC ..... *H04R 19/005* (2013.01); *H04R 7/24* (2013.01); *H04R 31/00* (2013.01); *H04R 19/04* (2013.01)

USPC ..... 381/174; 381/175; 381/191

(58) Field of Classification Search

USPC ..... 381/113, 116, 173, 174, 175, 369; 367/170, 181; 29/25.41, 25.42, 594; 438/53; 257/254, 415, 416

See application file for complete search history.

(56) References Cited

U.S. PATENT DOCUMENTS

| | | | | |
|---|---|---|---|---|
| 5,452,268 | A * | 9/1995 | Bernstein | 367/181 |
| 6,535,460 | B2 * | 3/2003 | Loeppert et al. | 367/181 |
| 7,146,016 | B2 * | 12/2006 | Pedersen | 381/175 |
| 8,045,734 | B2 * | 10/2011 | Zhe et al. | 381/175 |
| 2002/0067663 | A1 | 6/2002 | Loeppert et al. | |
| 2006/0093170 | A1 * | 5/2006 | Zhe et al. | 381/191 |
| 2007/0284682 | A1 | 12/2007 | Laming et al. | |
| 2008/0212409 | A1 | 9/2008 | Lutz | |
| 2008/0232615 | A1 | 9/2008 | Song et al. | |

FOREIGN PATENT DOCUMENTS

| | | |
|---|---|---|
| WO | 2007/085017 A1 | 7/2007 |
| WO | 2008/103672 A2 | 8/2008 |

* cited by examiner

*Primary Examiner* — Huyen D Le

(74) *Attorney, Agent, or Firm* — Seed IP Law Group PLLC

(57) ABSTRACT

A MEMS acoustic transducer provided with a substrate having cavity, and a membrane suspended above the cavity and fixed peripherally to the substrate, with the possibility of oscillation, through at least one membrane anchorage. The membrane comprises at least one spring arranged in the proximity of the anchorage and facing it, and is designed to act in tension or compression in a direction lying in the same plane as said membrane.

25 Claims, 11 Drawing Sheets

INTEGRATED ACOUSTIC TRANSDUCER OBTAINED USING MEMS TECHNOLOGY, AND CORRESPONDING MANUFACTURING PROCESS

BACKGROUND

1. Technical Field

The present disclosure relates to an integrated acoustic transducer in MEMS technology and to the corresponding manufacturing process, and in particular to a microelectromechanical (MEMS) microphone of a capacitive type.

2. Description of the Related Art

As is known, an acoustic transducer, for example, a MEMS microphone, of a capacitive type generally comprises a mobile electrode, in the form of a diaphragm or membrane, arranged facing a fixed electrode, to provide the plates of a capacitor. The mobile electrode is generally anchored, by means of a perimetral portion thereof, to a substrate, whilst a central portion thereof is free to move or bend in response to a pressure of sound wave acting on a surface of the mobile electrode. Since the mobile electrode and the fixed electrode form a capacitor, bending of the membrane that constitutes the mobile electrode causes a variation of capacitance of the capacitor. In use, said variation of capacitance is converted into an electrical signal, supplied as an output signal of the microphone.

As an alternative to MEMS microphones of a capacitive type, there are known MEMS microphones in which the movement of the membrane is detected by means of elements of a piezoresistive, piezoelectric, or optical type, or also exploiting the tunnel effect.

MEMS microphones of a known type are, however, subject to problems deriving from residual stresses (compressive or tensile) within the layer that forms the membrane. The factors that affect stress are multiple, and are due, for example, to the properties of the materials used, to the techniques of deposition of said materials, to the conditions (temperature, pressure, etc.) at which deposition is made, and to possible subsequent thermal treatments.

Residual stresses are frequently the cause of mechanical deformations of the membrane, such as for example warping or buckling, and can significantly affect the performance of the MEMS microphone, for example, reducing the sensitivity thereof.

Even though it is possible to control the amount of residual stress in the membrane by means of an appropriate design of the membrane itself and by evaluating the optimal manufacturing conditions, the result obtained is not satisfactory for applications in which a high sensitivity is required. In these cases in fact, the mechanical behavior in response to stresses of sound waves is in any case dominated by the level of residual stress in the membrane.

In order to overcome these problems, described in the document No. WO 2008/103672 is a MEMS microphone of a capacitive type in which the mobile electrode is suspended over a cavity by means of a single anchorage element fixed with respect to a supporting beam provided in the same layer in which the fixed electrode is formed. The point of coupling of the anchorage element with the mobile electrode is located in the center of the membrane that forms the mobile electrode. In this way, the mobile electrode can release the residual stresses through free radial contractions or expansions.

However, this solution is valid only in the cases in which the residual stresses in the supporting beam are small. If, instead, the supporting beam is subjected to tensile or compressive stresses, it tends to warp in an unforeseeable way, causing a deformation or an inclination of the mobile electrode, which hence assumes a position not parallel to the fixed electrode.

Furthermore, a membrane anchored at the center is very sensitive to the deformations due to the stress gradient.

There can hence occur problems of reduced sensitivity of the microphone during use, and, in more serious cases, a direct contact between the mobile electrode and the fixed electrode.

BRIEF SUMMARY

One embodiment is an integrated acoustic transducer obtained using MEMS technology and including a substrate having a cavity; a membrane anchorage fixed to the substrate; and a membrane suspended above said cavity and fixed peripherally to said substrate through the membrane anchorage. The membrane is configured to oscillate and includes a spring arranged near, and facing, said membrane anchorage and configured to act in tension or compression in a direction lying in a same plane as said membrane.

One embodiment is a corresponding manufacturing process that is free from the drawbacks of the known art.

BRIEF DESCRIPTION OF THE SEVERAL VIEWS OF THE DRAWINGS

For a better understanding of the present disclosure, preferred embodiments thereof are now described, purely by way of non-limiting example, with reference to the attached drawings, wherein.

DETAILED DESCRIPTION

Figure 1:
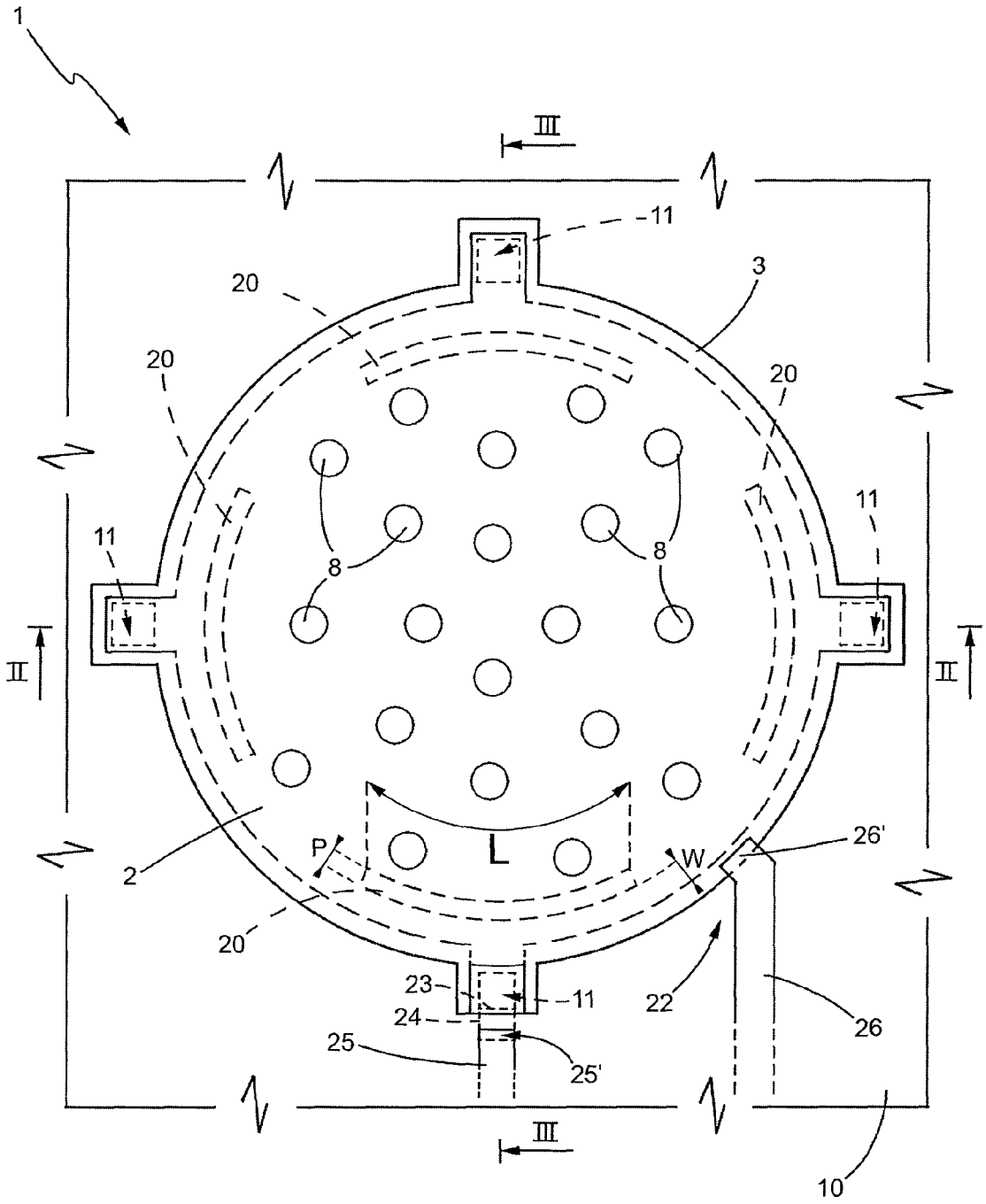
FIG. 1 shows, in top plan view, an assemblage of a rigid plate and a mobile membrane of an acoustic transducer according to one embodiment of the present disclosure.
Figure 2:
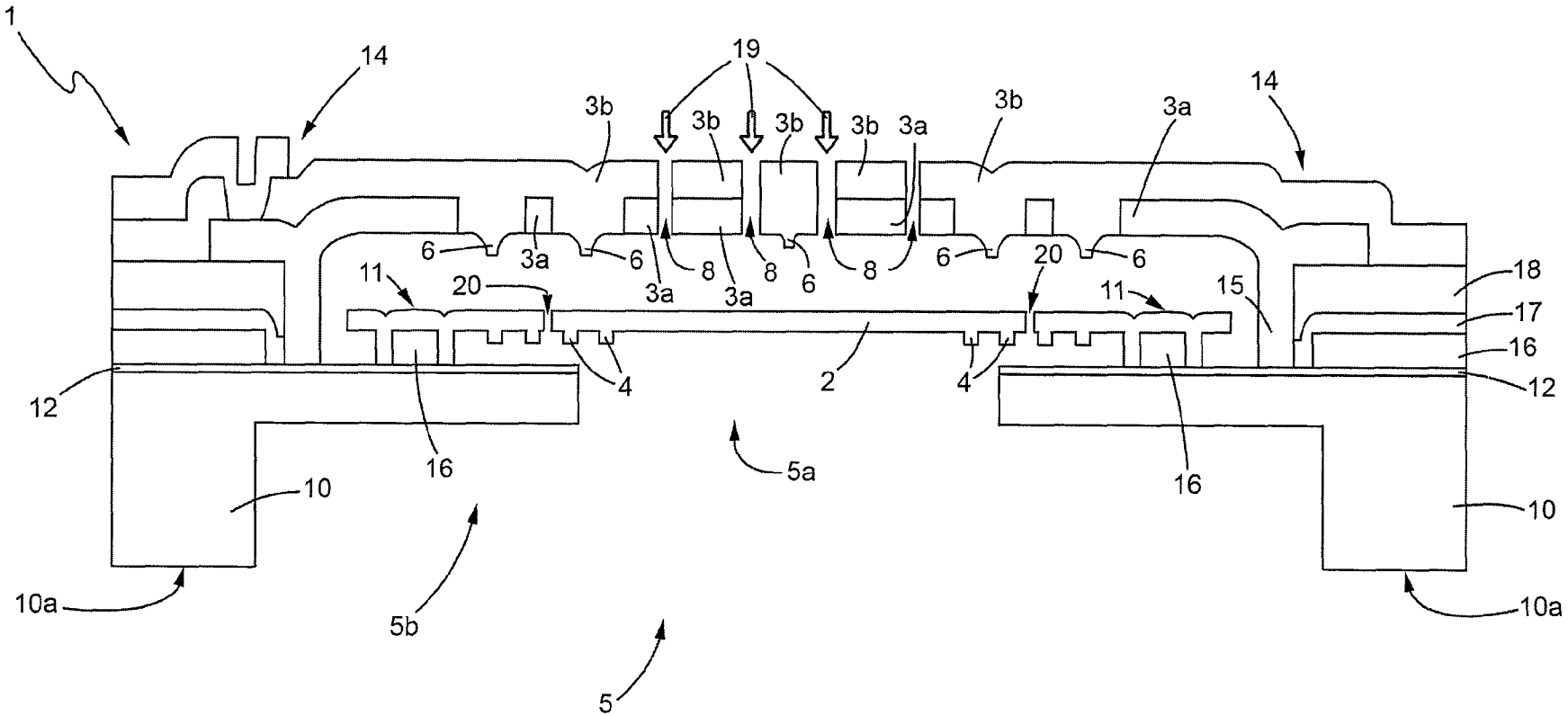
FIG. 2 shows a cross-sectional view of an assemblage of a rigid plate and a mobile membrane of the acoustic transducer of FIG. 1, along a line of cross section II-II of FIG. 1.
Figure 3:
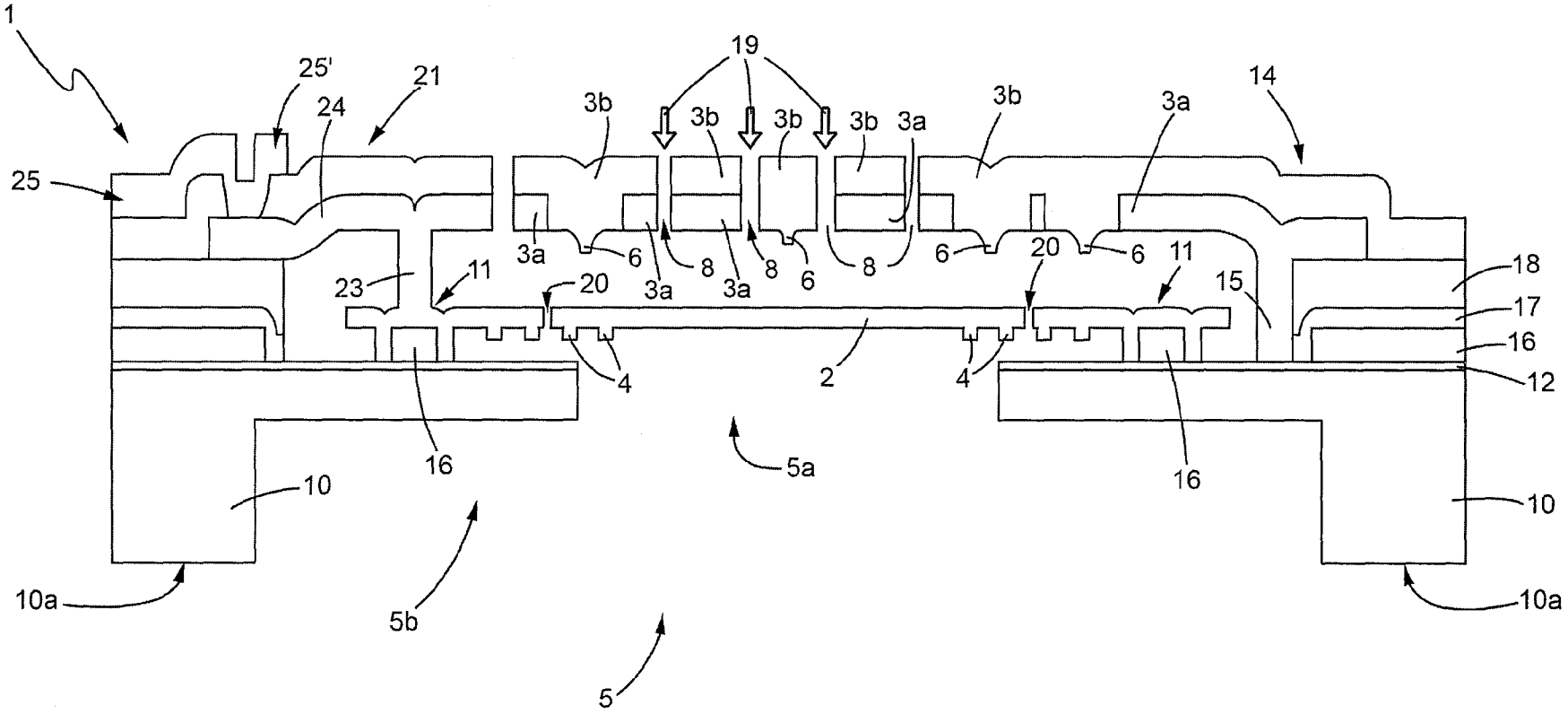
FIG. 3 shows a cross-sectional view of an assemblage of a rigid plate and a mobile membrane of the acoustic transducer of FIG. 1, along a line of cross section III-III of FIG. 1.

FIGS. 1-3 show, respectively, a top plan view and views in cross section of an assemblage of a membrane and a rigid plate of an integrated acoustic transducer obtained using MEMS technology, for example, a microelectromechanical microphone, according to one embodiment of the present disclosure. For reasons of simplicity, in what follows reference will be made to said assemblage generally as MEMS microphone 1, even though the electronics for supplying the microphone and for signal conditioning, are not shown and even though the description is not limited particularly to a microphone, but is valid for any acoustic transducer.

With joint reference to FIGS. 1 and 2, the MEMS microphone 1 is a microphone of a capacitive type and comprises a membrane 2, which is mobile and is made of conductive material, facing a rigid plate 3 (the so-called "back plate"), of a fixed type and formed by a first plate layer 3*a*, made of conductive material and facing the membrane 2, and by a second plate layer 3*b*, made of insulating material, superimposed on the first plate layer 3*a* with the exception of portions in which it extends through the first plate layer 3*a* to form protuberances that start from the rigid plate 3 as a prolongation thereof towards the membrane 2.

Said protuberances form first anti-stiction elements 6, having the function, during use, of preventing a direct contact between the membrane 2 and the conductive plate layer 3*a* of the rigid plate 3, which could seriously jeopardize the functions of the MEMS microphone 1.

Furthermore, the second plate layer 3*b* also performs, at least partially, a function of support for the first plate layer 3*a*. In this way, it is possible to uncouple the step of design of the mechanical supporting portion (second plate layer 3*b*) from the step of design of the capacitive sensing portion (first plate layer 3*a*), thus increasing the degree of freedom of design.

The membrane 2 is partially suspended above a substrate 10 and directly faces a cavity 5 (the so-called "back chamber"), which is obtained by digging from the back 10*a* of the substrate 10 and has the function of reference pressure chamber. The cavity 5 comprises: a first chamber 5*a*, having, for example, a circular shape, with a diameter smaller than the diameter of the membrane 2 and a depth in the range between 50 μm and 150 μm, preferably 100 μm; and a second chamber 5*b*, laying underneath the first chamber 5*a* and directly communicating therewith, having, for example, a circular shape, with a diameter equal to or greater than the diameter of the membrane 2 and a depth in the range between 350 μm and 500 μm, preferably 400 μm. The second chamber 5*b* consequently occupies an area larger than the area occupied by the first chamber 5*a*. In this way, it is possible to maximize simultaneously the superposition between the membrane 2 and the substrate 10 and the global volume of the cavity 5, improving in this way the response at low frequencies of the MEMS microphone 1 during use.

The membrane 2 is anchored to the substrate 10 by means of membrane anchorages 11, in the form of protuberances of the membrane 2 (for example, as may be seen more clearly in FIG. 1, in the number of four protuberances) in peripheral areas of the membrane 2. An insulation layer 12, for example, made of silicon nitride (SiN), formed on the substrate 10 enables, amongst other things, electrical insulation of the membrane anchorages 11 from the substrate 10. The membrane anchorages 11 have the function, not only of anchoring the membrane 2 to the substrate 10, but also that of suspending the membrane 2 above the substrate 10 at a distance therefrom. The thickness of the membrane anchorages 11 must consequently be chosen as compromise of functions of the MEMS microphone 1 and, for example, be between 0.5 μm and 2 μm, preferably 1.3 μm. The membrane 2 must in fact be arranged at a distance from the substrate 10 such as to obtain the desired compromise between linearity of response at low frequencies and noise of the microphone, introduced by phenomena of damping of a "squeeze-film" type due to the vicinity of the membrane 2 to the substrate 10 in the regions of superposition.

Advantageously, the membrane 2 possesses a plurality of second anti-stiction elements 4, made in the form of protuberances extending from the bottom surface of the membrane 2 towards the substrate 10. The second anti-stiction elements 4 have the function, during the manufacturing steps and during use of the MEMS microphone 1, of preventing the occurrence of events of sticking of the membrane 2 to the underlying insulation layer 12.

The rigid plate 3 is anchored to the substrate 10 by means of plate anchorages 14 provided in peripheral areas of the rigid plate 3, and comprising all or part of the perimetral edge of the rigid plate 3. In greater detail, the rigid plate 3 is anchored to the substrate 10 through rigid-plate supporting elements 15, for example, pillars made of the same material as the rigid plate 3, formed on the substrate 10 and on the insulation layer 12 and electrically insulated from the substrate 10 via the insulation layer 12 formed in between.

Furthermore, the rigid plate 3 rests peripherally on portions of a first sacrificial layer 16, a second sacrificial layer 17, and a third sacrificial layer 18, external to the area occupied by the membrane 2 and to the pillars 15. As an alternative to the pillars, the rigid-plate supporting elements 15 may comprise walls or embankments.

The pillars, walls, and embankments may advantageously comprise an internal portion of their own made of polysilicon, nitride or gold, so as not to be readily susceptible to phenomena of deformation. The pillars, walls, or embankments have in fact the function of preventing undesirable bending of the rigid plate 3.

The rigid plate 3 moreover comprises a plurality of holes 8, of any shape, preferably circular, having the function of favoring, during the manufacturing steps, removal of the underlying sacrificial layers (as will be explained more clearly in what follows) and, in use, enabling free circulation of air between the rigid plate 3 and the membrane 2, thus reducing the effect of squeeze-film damping. Furthermore, in use, the holes 8 have the function of acoustic input port, to enable sound-pressure waves 19, represented schematically in the figure as arrows, to deform the membrane 2.

As an alternative, in a way not shown in the figures, the sound-pressure waves 19 can reach the membrane 2 through the cavity 5, which hence performs, in this latter case, the function of acoustic input port.

In order to enable release of residual stresses (tensile and/or compressive stresses) in the membrane 2, for example, those deriving from the manufacturing process, trenches 20 are formed in the membrane 2, in particular in a position corresponding to and facing each membrane anchorage 11. Each trench 20 is defined by a length L of its own, by a width P of its own, and by a distance W between the trench 20 and the respective membrane anchorage 11 (or the perimetral edge of the membrane 2) which the trench 20 faces. The thickness of each trench is equal to the thickness of the membrane 2.

For example, considering a membrane 2 of a circular shape, with diameter comprised between 500 μm and 900 μm, each trench 20 can have a length L comprised between 80 μm and 140 μm, preferably approximately 100 μm, a width P comprised between 2 μm and 6 μm, preferably approximately 4 μm, and a distance W between the trench 20 and the respective membrane anchorage 11 comprised between 10 μm and 40 μm, preferably approximately 25 μm.

In the example shown in FIG. 1, each trench 20 has, in top plan view, an arched curved shape that follows the circular profile of the perimetral edge of the membrane 2. As may be seen more clearly in FIG. 2, each trench 20 cuts the membrane 2 through the entire thickness, thus defining a spring element provided inside the membrane 2 and as an integral part of the membrane 2 itself. In use, each trench 20 is designed to act in tension and compression as a spring, enabling radial contractions and expansions of the membrane 2 in a direction lying in one and the same plane in which the membrane 2 lies.

By varying the parameters of length L and width P and distance W from the edge of the membrane 2 of each trench 20, it is possible to vary the compressive/extensive characteristics of each trench 20, rendering the frequency of oscillation of the membrane 2 with a low dependence upon the residual stresses.

FIG. 3 shows a cross-sectional view of the MEMS microphone 1 along a cross section III-III of FIG. 1.

With joint reference to FIGS. 1 and 3, the MEMS microphone 1 moreover comprises a membrane contact 21 and a rigid-plate contact 22, both made of conductive material, employed, during use of the MEMS microphone 1, for biasing the membrane 2 and the rigid plate 3 and collecting a signal of variation of capacitance consequent upon a deformation of the membrane 2 caused by sound-pressure waves 19 impinging upon the membrane 2 itself.

As is shown in FIG. 3, the membrane contact 21 is formed in part in the same layer in which the rigid plate 3 is provided, but is electrically separated therefrom, for example, by appropriately shaping the rigid plate 3 so as to prevent any electrical contact with the membrane contact 21. In greater detail, the membrane contact 21 comprises: a plug 23, which is conductive and in direct electrical contact with the membrane 2; possibly a plug-connection portion 24, which is conductive and in electrical contact with the plug 23; and a conductive membrane path 25, for example, made of metal material, comprising a die pad 25' in electrical contact with the plug 23 through a plug-connection portion 24 (when the latter is present).

The plate contact 22 (visible in FIG. 1 in top plan view) can advantageously be provided entirely in the same layer in which the rigid plate 3 is provided, for example, made of the same material as the rigid plate 3, and comprises a conductive path 26 in electrical contact with the rigid plate 3 by means of a plate-contact portion 26'.

Figure 4A:
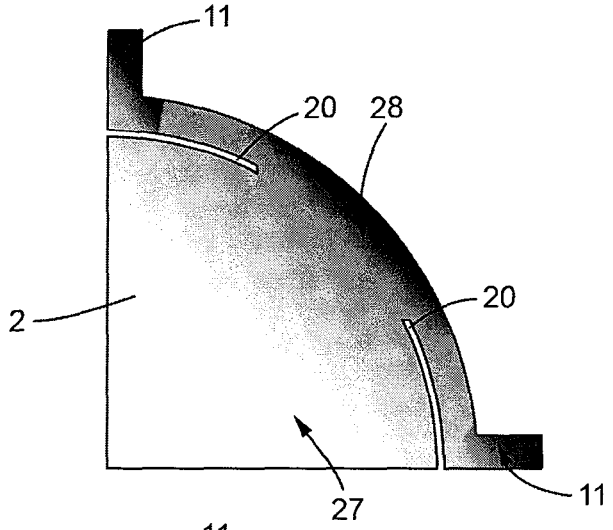
FIG. 4*a* shows a portion of mobile membrane of the acoustic transducer of FIGS. 1-3, equal to one quarter of the mobile membrane, subjected to deformations of a compressive type, during a simulation of use.
Figure 4B:
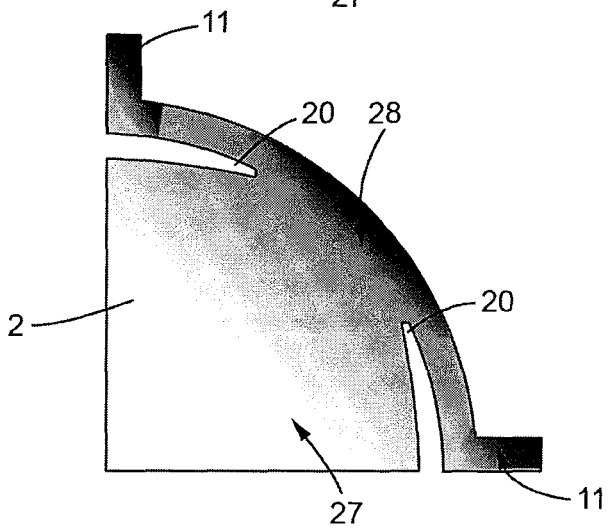
FIG. 4*b* shows a portion of mobile membrane of the acoustic transducer of FIGS. 1-3, equal to one quarter of the mobile membrane, subjected to deformations of a tensile type, during a simulation of use.

FIGS. 4*a* and 4*b* each shows a portion of membrane 2, equal to one quarter of the membrane 2, subjected to deformations of a compressive type (FIG. 4*a*) and to deformations of a tensile type (FIG. 4*b*), during a simulation of use. FIGS. 4*a* and 4*b* are grey-scale graphic representations, in which the light-grey areas are areas with low stress 27 and darker areas are areas with high stress 28.

From FIGS. 4*a* and 4*b* it may be noted that the areas with high stress 28 are areas of the membrane 2 not subtended by the arc formed by each trench 20. More in particular, they are peripheral areas of the membrane 2 that include the perimetral edge of the membrane 2 and are comprised between two adjacent trenches 20. The presence of the trenches 20 enables a considerable reduction in the level of stress on the rest of the membrane 2 (i.e., the low-stress areas 27).

Figure 5:
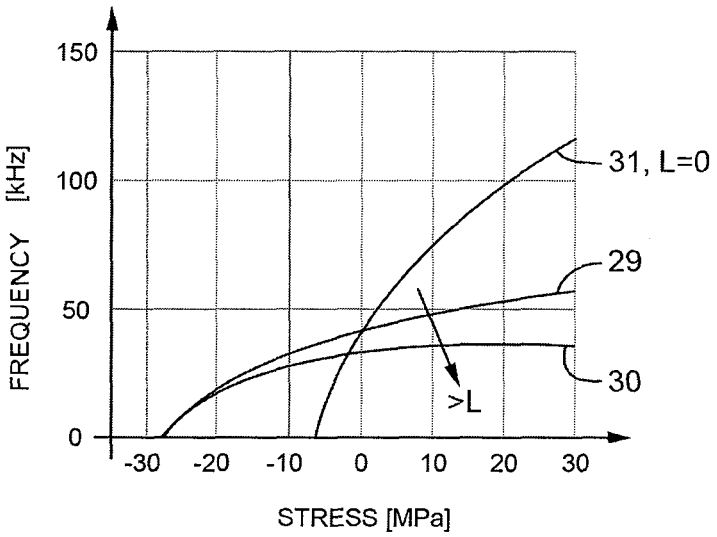
FIG. 5 is a graph showing plots of the frequency of a first vibrational mode of the mobile membrane of the acoustic transducer of FIGS. 1-3 versus the residual stresses in the mobile membrane itself.
Figure 6:
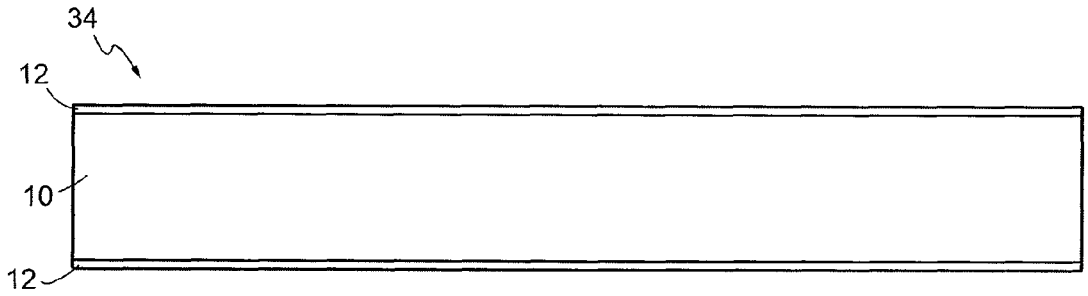
FIGS. 6-14 show a cross-sectional view of one half of the assemblage of FIG. 2 during successive manufacturing steps.
Figure 7:
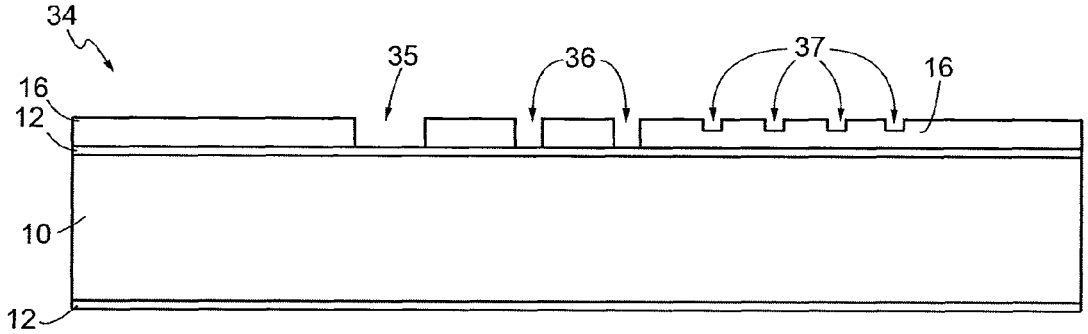
Figure 8:
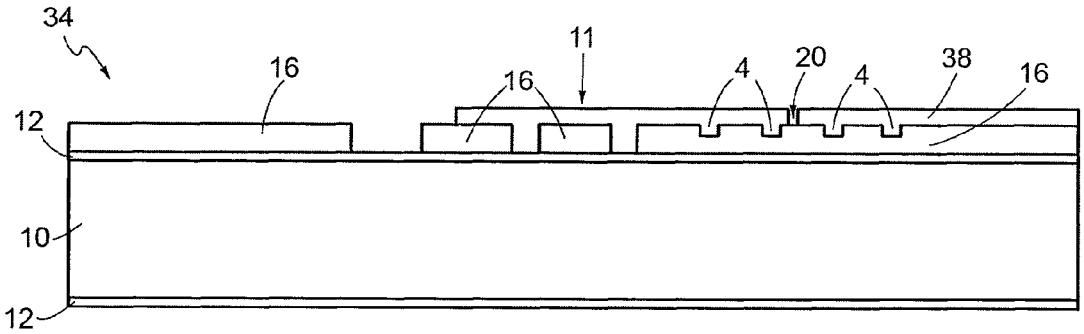
Figure 9:
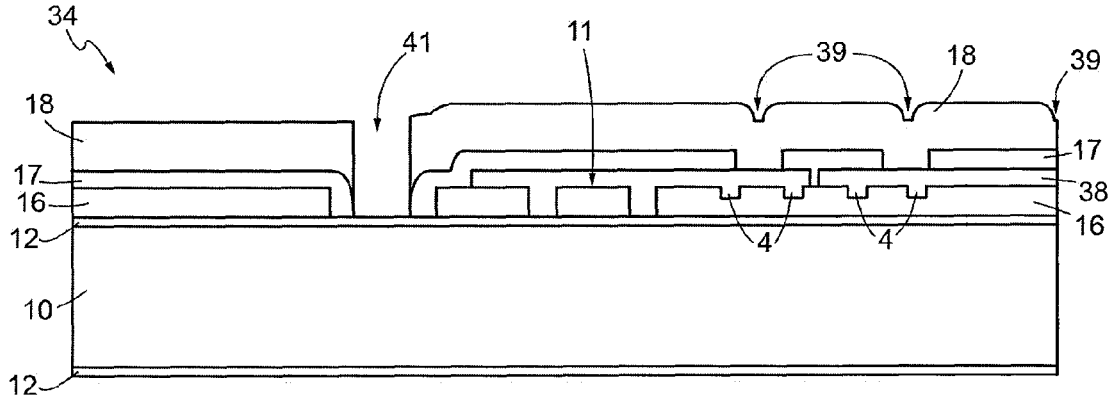
Figure 10:
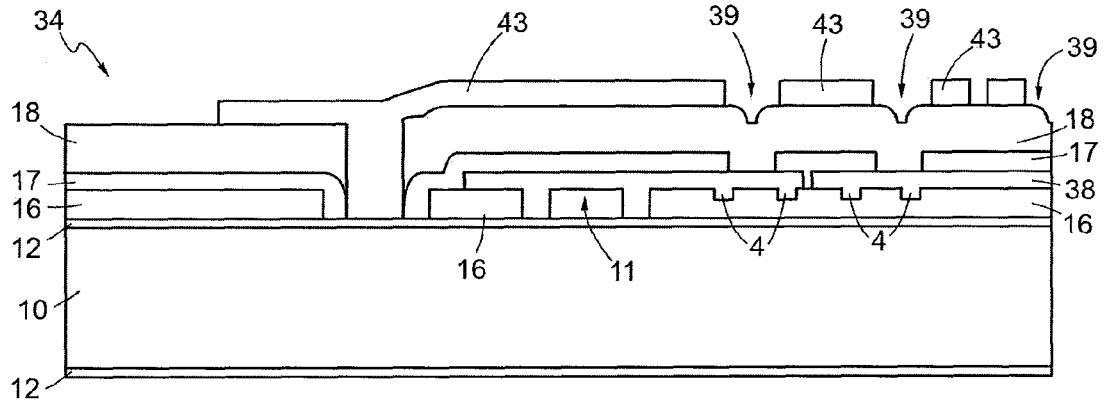
Figure 11:
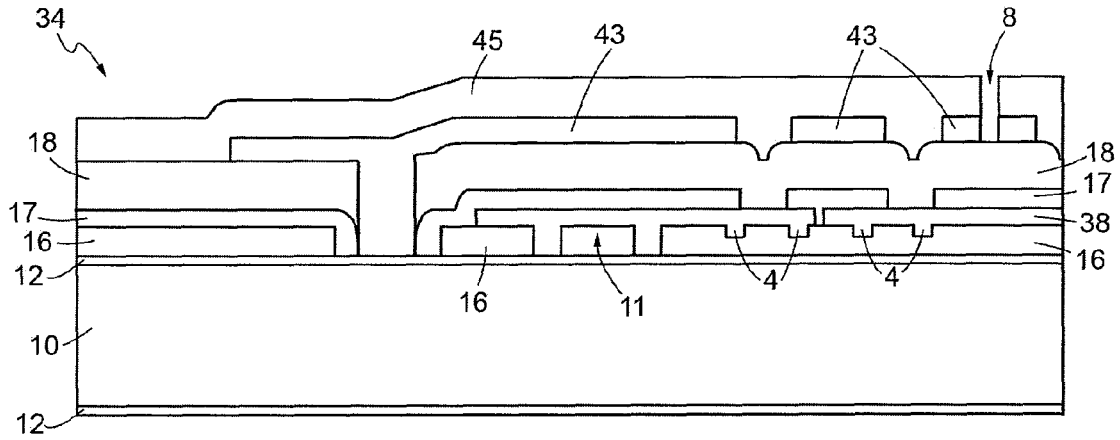

FIG. 5 is a graph that shows curves 29, 30 and 31 of evolution of the frequency regarding a first vibrational mode of the membrane 2 as a function of the residual stresses. The curves 29, 30 were obtained by fixing the values of distance W and width P for each trench 20 for two different values of length L. The curve 31 shows, instead, the case of a membrane 2 without the trenches 20.

As may be noted, by introducing the trenches 20 and increasing their length L, the frequency as a function of the residual stresses varies more slowly.

FIGS. 6-14 show successive manufacturing steps for obtaining a MEMS microphone similar to the MEMS microphone 1 of FIGS. 1-3, provided with trenches 20.

Initially (FIG. 6), a substrate 10 of a wafer 34 made of silicon of an N type is laid, which has, for example, a thickness in the range between 400 μm and 800 μm, preferably 725 μm. The substrate 10 is then subjected to a step of polishing on the front and on the back.

Then, deposited on the wafer 34 is an insulation layer 12, made, for example, of silicon nitride, preferably low-stress silicon nitride (LS-SiN), having a thickness in the range between 0.2 μm and 1 μm, for example, 0.75 μm.

Next (FIG. 7), a first sacrificial layer 16 is deposited, for example, made of doped glass (PSG—PhosphoSilicate Glass) or non-doped glass (TEOS—TetraEthylOrthoSilicate, USG—Undoped Silicate Glass), having a thickness in the range between 0.8 μm and 2 μm, preferably 1.3 μm. Then, the first sacrificial layer 16 is defined, for example, by dry etching, so as to form first openings 35 for subsequent formation of the plate anchorages 14, second openings 36 for a subsequent formation of the membrane anchorages 11, and first mould elements 37, having the function of mould for the formation of the second anti-stiction elements 4, as will be described more fully in what follows.

Next (FIG. 8), deposited on the wafer 34 is a membrane layer 38, of a conductive type, made, for example, of polysilicon with N doping, so as to fill the second openings 36 and the first mould elements 37 and form on the wafer 34 a layer having a thickness in the range between 0.3 μm and 1.5 μm, preferably 0.7 μm. In this way, the membrane anchorages 11 and the second anti-stiction elements 4 are formed. The membrane anchorages 11 comprise vertical portions formed within the second openings 36, in direct contact with the insulation layer 12, and a portion of the first sacrificial layer 12 comprised between the vertical portions of the membrane anchorages 11. The second anti-stiction elements 4 extend, instead, as protuberances, and have a shape and a thickness defined by the shape and by the depth of the first mould elements 37.

Next, by means of successive lithography and etching steps, for example, a dry etch, the membrane layer 38 is selectively removed with the exception of the area in which it is intended to form the membrane 2. In particular, during this step of etching of the membrane layer 38, the trenches 20 are also defined.

Then (FIG. 9), deposited on the wafer 34 is the second sacrificial layer 17, for example, USG with a thickness of approximately 0.6 μm. The second sacrificial layer 17 is defined so as to form a plurality of depressions or openings having the function of enabling, during the subsequent step of deposition of the third sacrificial layer 18, formation of second mould elements 39 to form the first anti-stiction elements 6. In fact, in the areas corresponding to the plurality of depressions or openings formed in the second sacrificial layer 17, the third sacrificial layer 18 has a surface shape that reproduces at least partially the shape of the second underlying sacrificial layer 17, to form precisely the second mould elements 39.

In this step, a third opening is formed (not shown) in the second and third sacrificial layers 17, 18 until the membrane layer 38 is reached, for subsequent formation of the conductive plug 23. There are then formed fifth openings 41 in the second and third sacrificial layers 17, 18 alongside the membrane layer 38, until the insulation layer 12 is reached.

The fifth openings 41 have the function of enabling formation of the pillars 15 of the plate anchorages 14.

Next (FIG. 10), a first rigid-plate layer 43 is formed on the wafer 34, to fill the fifth openings 41 and to form a conductive layer above the third sacrificial layer 18. The first rigid-plate layer 43 may, for example, be constituted by polysilicon with a doping of an N type, with a thickness in the range between 0.5 μm and 2 μm, preferably 0.9 μm. The first rigid-plate layer 43 is selectively removed to expose the second mould elements 39 formed in the second underlying sacrificial layer 17 and to form part of the holes 8.

A second rigid-plate layer 45 (FIG. 11) is formed on the wafer 34 so as to fill the second mould elements 39 to form the first anti-stiction elements 6. The second rigid-plate layer 45 is a layer of insulating material, for example, silicon nitride, with a thickness in the range between 0.7 μm an and 2 μm, preferably 1.2 μm. A subsequent etching step enables selective removal of the second rigid-plate layer 45 to complete formation of the holes 8 and to provide openings in which to form subsequently the die pad 25' in electrical contact with the plug 23 through the plug-connection portion 24 (the latter are not shown in FIG. 11).

Figure 12:
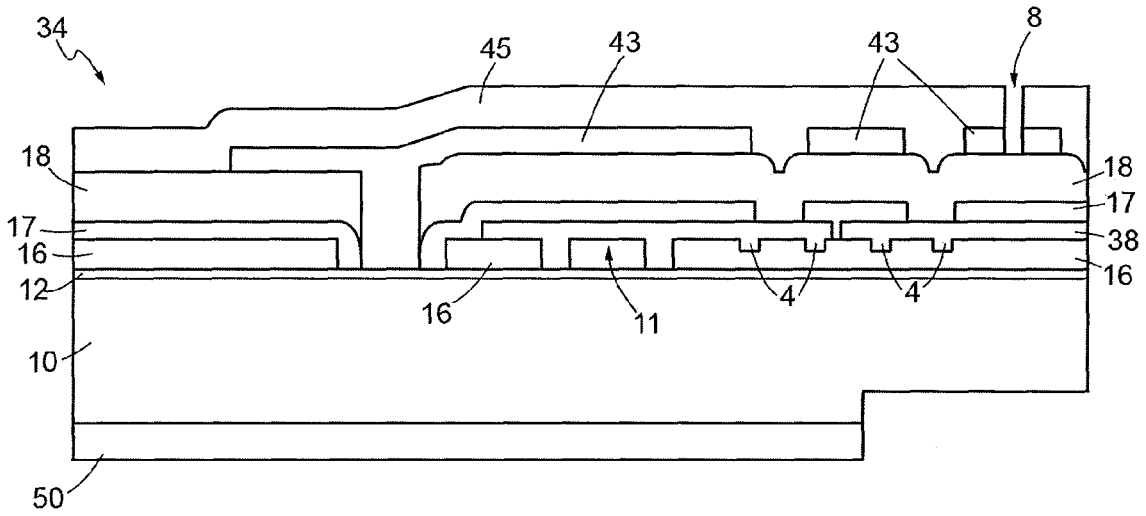
Figure 13:
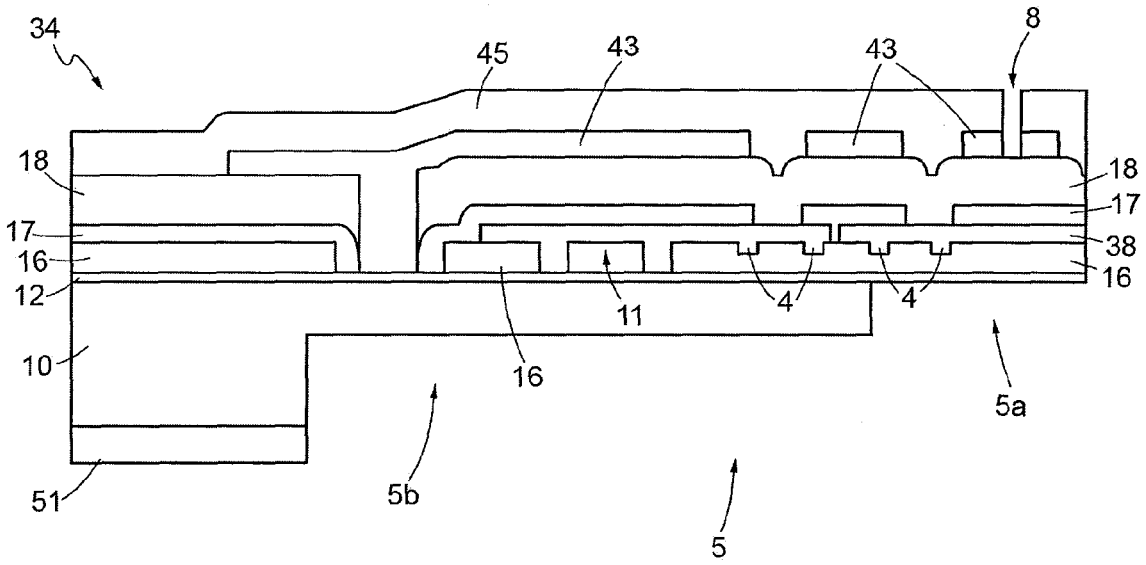
Figure 14:
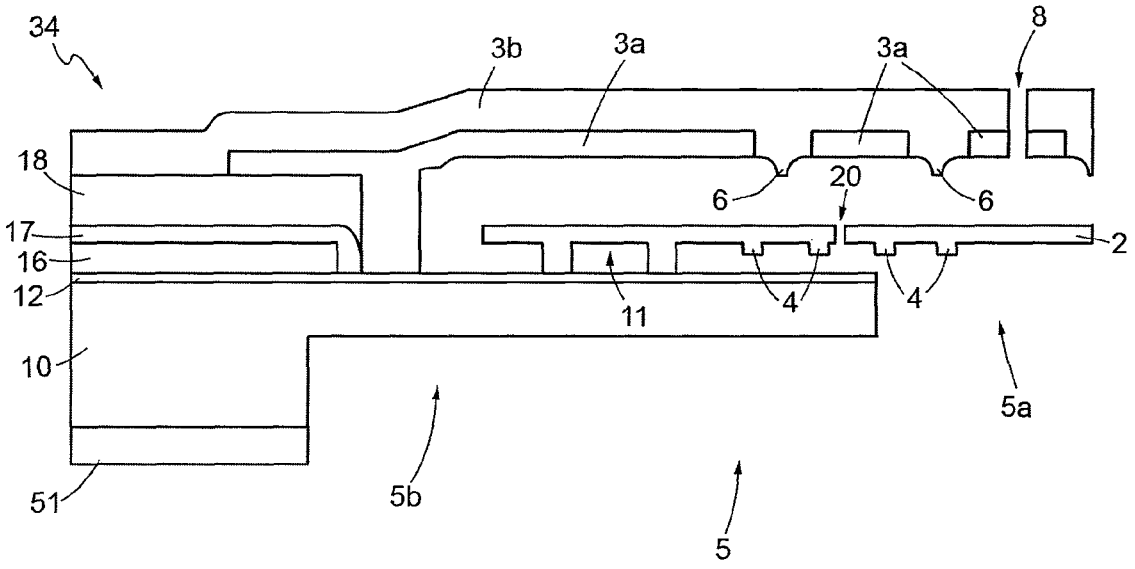

FIG. 12 shows a subsequent step of machining of the back of the wafer 34. In particular, by means of subsequent steps of etching and mechanical grinding (of a known type), the back of the wafer 34 is polished and thinned out, until a thickness in the range between 400 μm an and 600 μm an is reached, for example, 500 μm. To protect the front of the wafer 34 during these steps of polishing and thinning, it may be advantageous to deposit a protective layer on the front of the wafer 34, which must then be removed at the end of the manufacturing steps (not shown).

Then, by means of successive lithography and etching steps, the cavity 5 is formed. In greater detail, the cavity 5 is formed using a double dry etch.

In the first place (FIG. 12), a layer of TEOS oxide grown is on the back 10*a* of the wafer 34 and then defined to form first mask regions 50. A first dry etch is then made. The area of the substrate 10 subjected to etching is defined by the first mask regions (i.e., the area of the substrate 10 not coated by the first mask regions), whilst the depth of the etched substrate portion 10 is equal to the depth that it is desired to obtain for the first chamber 5*a*. Then (FIG. 13), the first mask regions 50 are partially removed to form second mask regions 51 that define the area of the second chamber 5*b*, having an amplitude greater than the area of the first chamber 5*a*, and a further dry etch on the back of the wafer 34 enables removal of the substrate 10, where it is not protected by the second mask regions 51, until the insulation layer 12 is partially exposed. The second mask portions 51 are then removed. There is thus simultaneously formed the first chamber 5*a* and the second chamber 5*b*. Finally, by removing the exposed portion of insulation layer 12, the first sacrificial layer 16 is partially exposed. In this way, a cavity 5 is formed, the maximum amplitude of which (represented by the amplitude of the second chamber 5*b*) is independent of the arrangement of the membrane anchorages 11 of the membrane 2.

Finally (FIG. 14), a wet etch, for example, made with hydrofluoric acid (HF), enables removal of the first, second, and third sacrificial layers 16, 17 and 18 underneath the membrane layer 38, of the first rigid-plate layer 43 and of the second rigid-plate layer 45 where they are not protected, thus forming the membrane 2 and the rigid plate 3 suspended on the substrate 10 and on the cavity 5.

This etch is divided in two separate parts, the first part of the etch is only aimed at freeing the device from the sacrificial layer 16, whilst the front is protected by a protective layer resistant to acid, for example, resist. Once complete or partial freeing of the sacrificial layer 16 has been carried out, the removal of the coating by dry etching is performed, and then the sacrificial oxide layers 17 and 18 are freed. This process enables a more reliable check on the residual thickness of the dielectric layers 12 and 45 (which are of determining importance for functionality of the device) during freeing.

In this way, a MEMS microphone is formed similar to the MEMS microphone 1 of FIG. 2.

It is clear that the manufacturing steps described can be used for producing a plurality of MEMS microphones on one and the same wafer 34.

Figure 15:
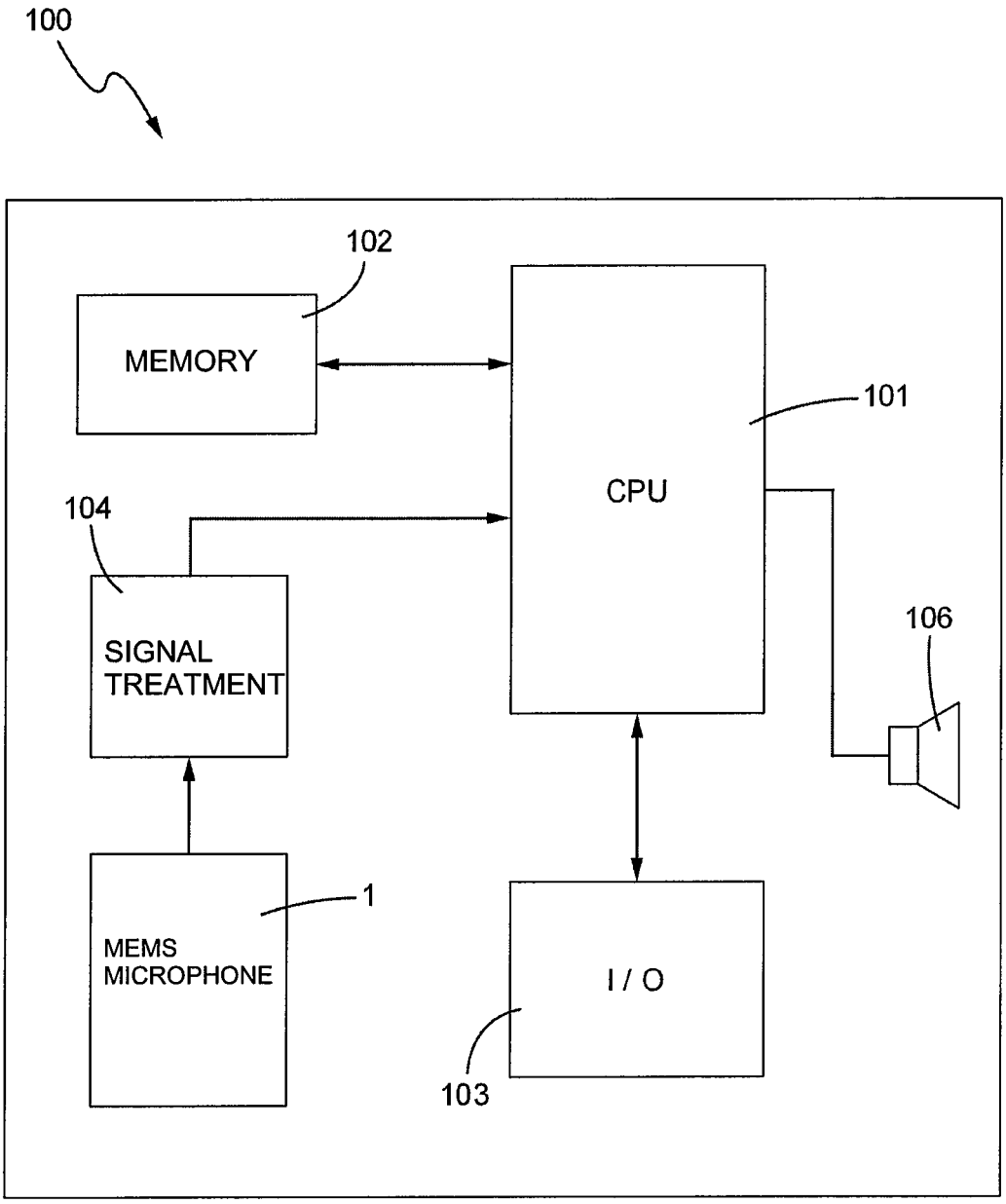
FIG. 15 shows a device that uses an acoustic transducer according to the present disclosure.

FIG. 15 shows an electronic device 100 that uses one or more MEMS microphones 1 (just one MEMS microphone 1 is shown in the figure).

The electronic device 100 comprises, in addition to the MEMS microphone 1, a microprocessor 101, a memory block 102, connected to the microprocessor 101, and an input/output interface 103, for example, a keyboard and a monitor, which are also connected to the microprocessor 101. The MEMS microphone 1 communicates with a microprocessor 101 via a signal-treatment block 104, for example, an amplifier. In addition, there may be present a loudspeaker 106, for generating a sound on an audio output (not shown) of the electronic device 100.

The electronic device 100 is preferably a mobile-communication device, such as, for example, a cell phone, a PDA, a notebook, but also a voice recorder, a reader of audio files with voice-recording capacity, etc. Alternatively, the electronic device 100 may be a hydrophone capable of working under water.

From an examination of the characteristics of the MEMS acoustic transducer provided according to the present disclosure, the advantages that it enables emerge clearly.

In particular, by forming notches or trenches in the membrane 2 that have the function of springs configured for withstanding radial contractions or expansions, the resonance frequency of the membrane 2, and hence the sensitivity of the device that uses it (for example, a microphone) are substantially independent of the residual stresses in the layer that forms the membrane 2 itself and consequently have a low dependence both upon the manufacturing-process spreads and upon the thermomechanical stresses induced by the package (temperature stability). Furthermore, thanks to said springs, since the membrane 2 tends to release stresses, also its rigidity has low dependence upon the intensity of said residual stresses for a wide range of values (between +20 MPa and +80 MPa), which can be chosen by varying the geometrical parameters L, W, P (as described with reference to FIG. 1) according to the values of diameter and thickness of the membrane.

Furthermore, by forming the notches or the trenches it is possible to reduce the effects of the process variabilities intrinsic in mass-production processes.

Finally, it is clear that modifications and variations may be made to the MEMS microphone 1 described and illustrated herein, without thereby departing from the sphere of protection of the present disclosure, as defined in the annexed claims.

Figure 16:
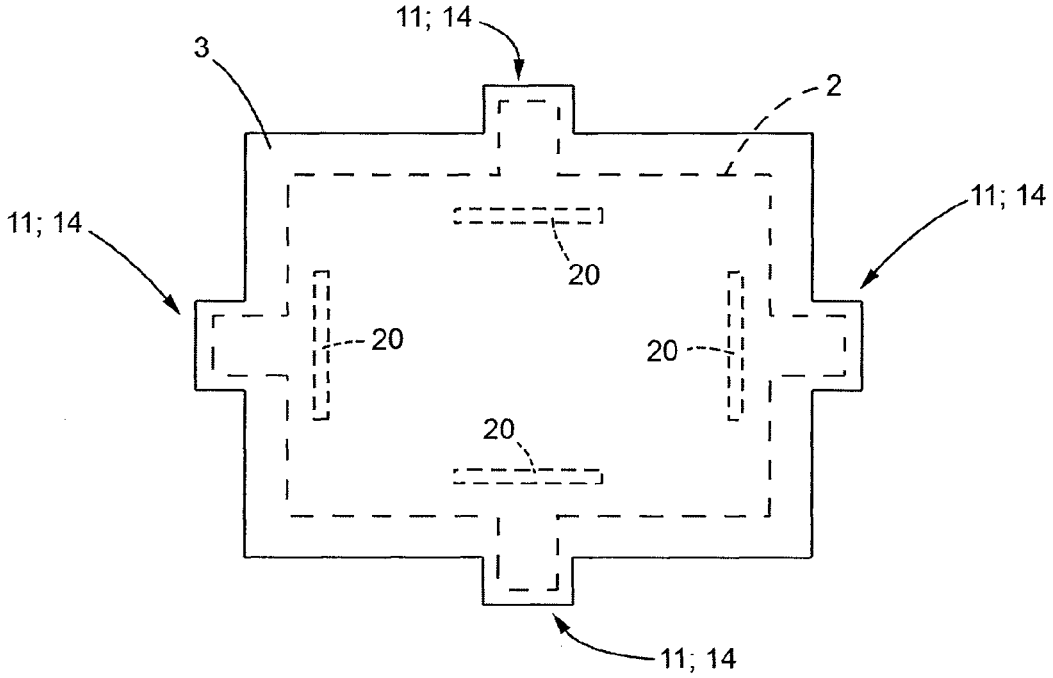
FIGS. 16 and 17 show, in top plan view, respective assemblages of a rigid plate and a mobile membrane of an acoustic transducer according to further embodiments of the present disclosure.
Figure 17:
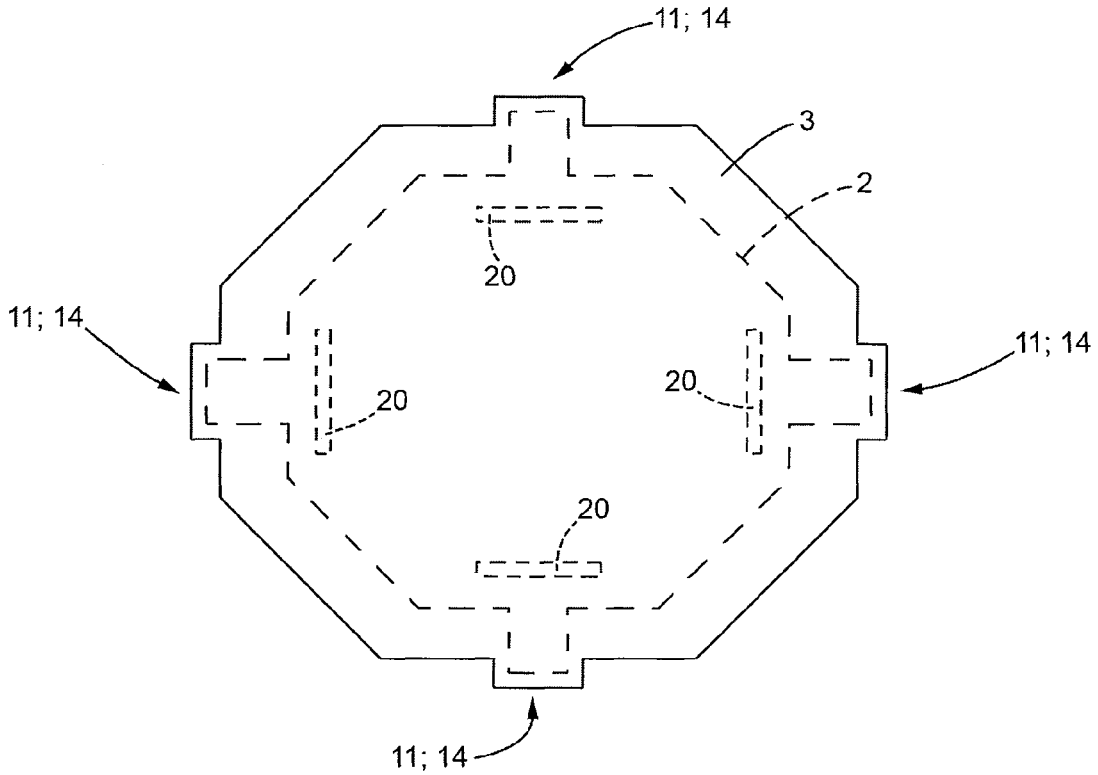

For instance, as is shown schematically in FIGS. 16 and 17, the membrane 2 and the rigid plate 3 can have a shape different from the circular one; for example, they may have a quadrangular shape (FIG. 16) or a generally polygonal shape (FIG. 17) according to the needs.

Figure 18A:
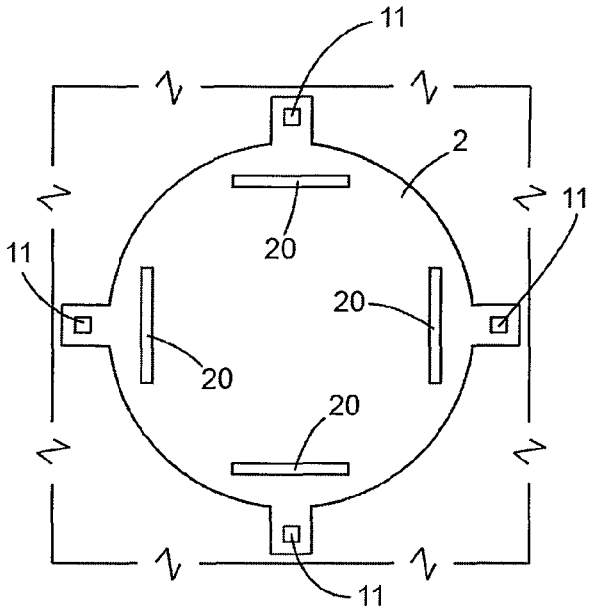
FIGS. 18*a*-18*c* show alternative embodiments of notched springs of the mobile membrane.
Figure 18B:
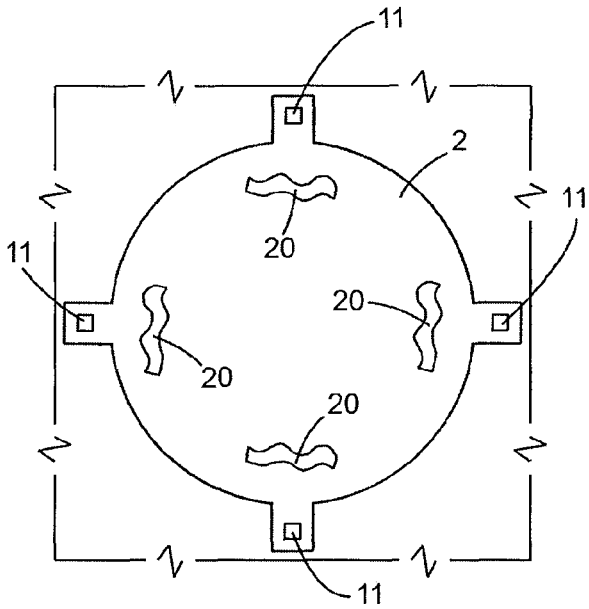
Figure 18C:
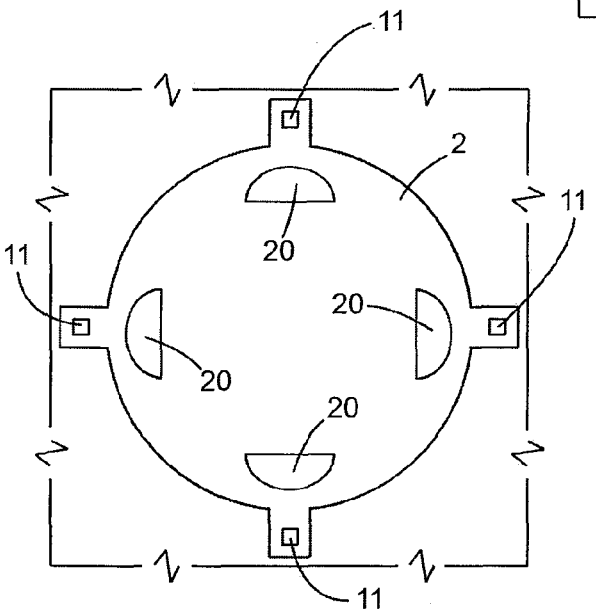

In addition, as shown in FIGS. 18*a*-18*c*, the trenches 20 can have a shape different from the arched shape, for example, a rectangular or generally polygonal shape (FIG. 18*a*), an undulated one or polygonal one with chamfered corners (FIG. 18*b*), or else be crescent-shaped (FIG. 18*c*).

Finally, is clear that the fixed plate 3 and the membrane 2 can be made of any conductive material other than doped polysilicon, for example, gold or aluminum.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A MEMS acoustic transducer, comprising:

a substrate having a cavity;

membrane anchors; and a suspended membrane coupled to the substrate by the membrane anchors, the suspended membrane located above said cavity and entirely suspended between the membrane anchors, said suspended membrane being configured to oscillate and including a first through-hole that is entirely surrounded on all sides by the suspended membrane and arranged near a first one of the membrane anchors, the first through-hole being configured to release tension and compression that acts in a direction lying in a same plane as said suspended membrane, said suspended membrane comprising a second through-hole arranged near a second one of the membrane anchors, the second one of the membrane anchors extending toward the substrate from the peripheral region and fixed to said substrate, wherein each of said first and second through-holes has an elongated shape having a first pair of lateral-delimitation sides having a length between 80 μm and 140 μm, and a second pair of lateral-delimitation sides having a length between 2 μm and 6 μm, said first through-hole being arranged at a distance from the first one of membrane anchors between 10 μm and 40 μm and said second through-hole being arranged at a distance from the second one of the membrane anchors between 10 μm and 40 μm.

2. The MEMS acoustic transducer according to claim 1, wherein said the through-hole has an arched curved shape that substantially corresponds to a circular profile of a perimeter of said suspended membrane.

3. The MEMS acoustic transducer according to claim 2, wherein the through-hole has a thickness equal to a thickness of the suspended membrane and an elongated shape chosen from amongst: rectangular, arched, undulated, polygonal, polygonal with rounded corners, crescent-shaped.

4. The MEMS acoustic transducer according to claim 1, comprising an electrode arranged at a distance from and facing the suspended membrane, said electrode being made of conductive material and forming a capacitor with the central portion of the suspended membrane.

5. The MEMS acoustic transducer according to claim 4, wherein said electrode comprises an electrode anchorage anchored to the substrate, said electrode anchorage being arranged near said first one of the membrane anchors.

6. The MEMS acoustic transducer according to claim 1, wherein said suspended membrane has an area, and said cavity comprises a first chamber and a second chamber, the first chamber facing the suspended membrane and having an area smaller than the area of the suspended membrane, and the second chamber being arranged as an extension of the first chamber and having an area larger than the area of said first chamber.

7. The MEMS acoustic transducer according to claim 1, wherein the suspended membrane includes a protuberance extending outwardly and the first one of the membrane anchors extends from the protuberance toward the substrate.

8. The MEMS acoustic transducer according to claim 1, wherein the membrane anchors are coupled to a dielectric layer on the substrate.

9. A MEMS acoustic transducer comprising:

a substrate having a cavity;

membrane anchors:

a suspended membrane coupled to the substrate by the membrane anchors, the suspended membrane located above said cavity and entirely suspended between the membrane anchors, said suspended membrane being configured to oscillate and including a first through-hole that is entirely surrounded on all sides by the suspended membrane and arranged near a first one of the membrane anchors, the first through-hole being configured to release tension and compression that acts in a direction lying in a same plane as said suspended membrane;

an electrode arranged at a distance from and facing the suspended membrane, said electode being made of conductive material and forming a capacitor with the central portion of the suspended membrane;

an insulating plate arranged above said electrode; and first anti-stiction elements extending through said electrode and projecting beyond said electrode towards said membrane.

10. The MEMS acoustic transducer according to claim 9, wherein said suspended membrane comprises second anti-stiction elements extending towards said substrate.

11. An electronic device, comprising:

a MEMS transducer that includes:

a substrate having a cavity a plurality of membrane anchors; and a suspended membrane coupled to the substrate by the plurality of membrane anchors, the suspended membrane being suspended above said cavity and detached from the substrate except at the plurality of membrane anchors, the suspended membrane including a through-hole arranged near a first one of the membrane anchors and entirely surrounded on all sides by the suspended membrane, said suspended membrane comprising a second through-hole arranged near a second one of the membrane anchors, wherein each of said first and second through-holes has an elongated shape having a first pair of lateral-delimitation sides having a length between 80 μm and 140 μm, and a second pair of lateral-delimitation sides having a length between 2 μm and 6 μm, said first through-hole being arranged at a distance from the first one of the membrane anchors between 10 μm and 40 μm and said second through-hole being arranged at a distance from the second one of the membrane anchors between 10 μm and 40 μm.

12. The electronic device according to claim 11, wherein the through-hole has a shape that substantially corresponds to the perimeter of said suspended membrane.

13. The electronic device according to claim 11, further comprising a CPU coupled to the acoustic transducer and a memory coupled to the CPU.

14. The electronic device according to claim 11, wherein the suspended membrane includes a protuberance extending outwardly from the first one of the membrane anchor that is coupled to the substrate.

15. The electronic device according to claim 11, further comprising a dielectric layer located between the membrane anchors from the substrate.

16. The electronic device according to claim 11, wherein said electronic device is at least one of a cell phone, a PDA, a notebook, a voice recorder, an audio player with functionalities of voice recorder, a console for videogames, and a hydrophone.

17. A process, comprising:

manufacturing a MEMS transducer, the manufacturing including:

forming a cavity in a substrate;

forming a plurality of member anchors;

forming a membrane suspended above the cavity such that the membrane is suspended above the cavity and decoupled from the substrate except at the plurality of member anchors, the suspended membrane being configured to oscillate; and forming in the suspended membrane a first through-hole arranged near a first one of the membrane anchors and entirely surrounded on all sides by the suspended membrane, said through-hole being configured to release tension and compression acting in a direction lying in a same plane as said suspended membrane, wherein forming a cavity comprises defining an initial cavity by etching from a back side of said substrate using a first mask having a first window with a first area, the method further comprising etching from the back side of said substrate using a second mask having a second window with a second area larger than the first area, and simultaneously forming a first chamber having the first area and facing said membrane, and a second chamber commununicating with said first chamber and having the second area.

18. The process according to claim 17, wherein forming in the suspended membrane the first through-hole comprises forming a cut in said suspended membrane in a position corresponding to and facing said first one of the membrane anchors.

19. The process according to claim 17, further comprising forming an electrode at a distance from and facing the suspended membrane, said suspended membrane and said electrode being made of conductive material.

20. The process according to claim 19, wherein forming said membrane and said electrode comprises:

forming a first sacrificial layer on the substrate;

forming a membrane layer on said first sacrificial layer;

defining said membrane layer;

forming a second sacrificial layer on said membrane layer;

depositing an electrode layer on said second sacrificial layer and defining said electrode layer so as to form an electrode separated from said membrane through said second sacrificial layer;

removing said first sacrificial layer, so as to suspend said membrane over the substrate; and partially removing said second sacrificial layer so as to suspend the electrode above the membrane.

21. The process according to claim 20, wherein forming said second sacrificial layer includes forming openings in said second sacrificial layer, and defining said electrode layer comprises removing portions of said electrode layer in positions corresponding to said openings, said process further comprising depositing an insulating layer on said first electrode layer and within said openings, so as to form protuberances extending through said first electrode layer and projecting beyond said electrode layer towards said membrane.

22. A MEMS acoustic transducer comprising:

a substrate having a cavity;

a membrane suspended above said cavity and including a central region, a peripheral region surrounding the central region, and a first membrane anchorage extending toward the substrate from the peripheral region and fixed to said substrate, said membrane being configured to oscillate and including a first spring arranged near said first membrane anchorage and configured to act in tension and compression in a direction lying in a same plane as said membrane;

an electrode arranged at a distance from and facing the membrane, said electrode being made of conductive material and forming a capacitor with the central portion of the membrane;

an insulating plate arranged above said electrode; and first anti-stiction elements extending through said electrode and projecting beyond said electrode towards said membrane.

23. The MEMS acoustic transducer according to claim 22, wherein said membrane comprises second anti-stiction elements extending towards said substrate.

24. A process comprising:

manufacturing a MEMS transducer, the manufacturing including:

forming a cavity in a substrate;

forming a membrane suspended above the cavity and including a central region, a peripheral region surrounding the central region, and a first membrane anchorage extending toward the substrate from the peripheral region and fixed to said substrate, the membrane being configured to oscillate;

forming in the membrane a first spring arranged near said first membrane anchorage, said spring being configured to act in tension and compression in a direction lying in a same plane as said membrane; and forming an electrode at a distance from and facing the membrane, said membrane and said electrode being made of conductive material, wherein forming said membrane and said electrode comprises:

forming a first sacrificial layer on the substrate;

forming a membrane layer on said first sacrificial layer;

defining said membrane layer;

forming a second sacrificial layer on said membrane layer;

depositing an electrode layer on said second sacrificial layer and defining said electrode layer so as to form an electrode separated from said membrane through said second sacrificial layer;

removing said first sacrificial layer, so as to suspend said membrane over the substrate; and partially removing said second sacrificial layer so as to suspend the electrode above the membrane.

25. The process according to claim 24, wherein forming said second sacrificial layer includes forming openings in said second sacrificial layer, and defining said electrode layer comprises removing portions of said electrode layer in positions corresponding to said openings, said process further comprising depositing an insulating layer on said first electrode layer and within said openings, so as to form protuberances extending through said first electrode layer and projecting beyond said electrode layer towards said membrane.

* * * * *

UNITED STATES PATENT AND TRADEMARK OFFICE

CERTIFICATE OF CORRECTION

PATENT NO. : 8,942,394 B2
APPLICATION NO. : 12/644602
DATED : January 27, 2015
INVENTOR(S) : Sebastiano Conti et al.

It is certified that error appears in the above-identified patent and that said Letters Patent is hereby corrected as shown below:

On the Title Page

Item (30):
"Dec. 23, 2008 (IT)....TO2008A0983" should read, --Dec. 23, 2008 (IT)....TO2008A000983--.

Signed and Sealed this
Twenty-ninth Day of September, 2015

Michelle K. Lee

Michelle K. Lee
*Director of the United States Patent and Trademark Office*